US006411269B1

(12) United States Patent
Zimlich

(10) Patent No.: US 6,411,269 B1
(45) Date of Patent: Jun. 25, 2002

(54) COLUMN CHARGE COUPLING METHOD AND DEVICE

(75) Inventor: David A. Zimlich, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/196,511

(22) Filed: Nov. 20, 1998

Related U.S. Application Data

(63) Continuation of application No. 08/538,136, filed on Oct. 2, 1995, now Pat. No. 5,867,136.

(51) Int. Cl.[7] ..... G09G 3/22
(52) U.S. Cl. ..... 345/75.2; 315/169.1
(58) Field of Search ..... 345/74, 75, 147, 345/204, 208, 75.2; 315/169.1, 169.2

(56) References Cited

U.S. PATENT DOCUMENTS 5,262,698 A * 11/1993 Dunham ..... 315/169.1
5,357,172 A * 10/1994 Lee et al. ..... 315/167
5,387,844 A * 2/1995 Browning ..... 315/169.3
5,638,086 A * 6/1997 Lee et al. ..... 345/74
6,204,834 B1 * 3/2001 Baker et al. ..... 345/74

* cited by examiner

*Primary Examiner*—Vijay Shankar
*Assistant Examiner*—Vanel Frenel
(74) *Attorney, Agent, or Firm*—Hale and Dorr LLP

(57) ABSTRACT

An apparatus is provided for modulating a conductive element in an FED device from a first level to a second level in which the charge on the display is conserved. In one embodiment, the apparatus has a primary modulator having a first input connected to a first signal representative of the second level, an output connected to the conductive element, and a second input connected to a first signal representative of the output; and a connector of a modifying voltage to the output, the connector having a first input connected to a second signal representative of the second level and a second input connected to a second signal responsive to the output.

6 Claims, 16 Drawing Sheets

FIELD EMISSION DISPLAY
CROSS SECTION

FIELD EMISSION DISPLAY

COLUMN CHARGE COUPLING METHOD AND DEVICE

CROSS-REFERENCE TO RELATED APPLICATION

This application is a continuation of Ser. No. 08/538,136, filed Oct. 2, 1995, now U.S. Pat. No. 5,867,136.

BACKGROUND OF THE INVENTION

This invention relates to the field of electronic displays, and, more particularly, field emission display ("FED") devices.

As technology for producing small, portable electronic devices progresses, so does the need for electronic displays which are small, provide good resolution, and consume small amounts of power in order to provide extended battery operation. Past displays have been constructed based upon cathode ray tube ("CRT") or liquid crystal display ("LCD") technology. However, neither of these technologies is perfectly suited to the demands of current electronic devices.

CRT's have excellent display characteristics, such as, color, brightness, contrast and resolution. However, they are also large, bulky and consume power at rates which are incompatible with extended battery operation of current portable computers.

LCD displays consume relatively little power and are small in size. However, by comparison with CRT technology, they provide poor contrast, and only limited ranges of viewing angles are possible. Further, color versions of LCDs also tend to consume power at a rate which is incompatible with extended battery operation.

As a result of the above described deficiencies of CRT and LCT technology, efforts are underway to develop new types of electronic displays for the latest electronic devices. One technology currently being developed is known as "field emission display technology." The basic construction of a field emission display, or ("FED") is shown in FIG. 1. As seen in the figure, a field emission display comprises a face plate 100 with a transparent conductor 102 formed thereon. Phosphor dots 112 are then formed on the transparent conductor 102. The face plate 100 of the FED is separated from a baseplate 114 by a spacer 104. The spacers serve to prevent the baseplate from being pushed into contact with the faceplate by atmospheric pressure when the space between the baseplate and the faceplate is evacuated. A plurality of emitters 106 are formed on the baseplate. The emitters 106 are constructed by thin film processes common to the semi-conductor industry. Millions of emitters 106 are formed on the baseplate 114 to provide a spatially uniform source of electrons.

In order to cause the emitters to emit electrons, a plurality of electrodes are also formed on the baseplate. The electrodes are typically formed in a grid fashion with the row electrodes 108 formed on the baseplate and the column electrodes 110 formed on an insulator 116 attached to the baseplate.

FIG. 2 is a 3-dimensional cross-section showing the construction of row electrodes 202 and column electrodes 204. When a differential voltage is applied between a row electrode and a column electrode, an electric field is created at the tip of the emitters located at the intersection of the row and the column. The electric field at the tip of the emitter is controlled by the sum of the row and column voltages and is sufficiently high to cause electrons to tunnel through the surface of the emitter, into the vacuum, with no loss of energy. Virtually all the electrons bombard the phosphor, resulting in a bright display. Gray-scale or color can be achieved by varying the voltage applied to the column.

The number of row and column electrodes required will depend on the number of individual display elements, or "pixels," to be addressed by the electrodes. FIG. 3 illustrates the row and column electrodes required for a standard VGA display having 640 columns by 480 rows. Additionally, for a color display, each column requires a separate electrode for red, green, and blue elements. Therefore, a total of 1920 column electrodes are required.

A drive circuit is required to generate the desired voltage differential between each of the row and column electrodes. In a "passive matrix" drive scheme, each conductor requires a separate drive circuit. Referring still to FIG. 3, an image is created on an FED by sequentially "scanning" the rows. First, a voltage source 300 is used to apply a voltage row 302-1 to drive it to the appropriate voltage level. Second, all columns 304-1 to 304-1920 are driven to a voltage level related to the desired brightness of the relevant pixel using a circuit known as a "pulse height modulator" (not shown). The modulator sends pulses to its corresponding column electrode (304-1 to 304-1920) in which the height of the pulses depends on the desired brightness of the pixel. Third, all columns are turned off and row 302-1 is turned off. Finally, row 302-2 is then turned on and the process is repeated for rows 302-2 through 302-480. FIG. 3A is a timing diagram showing the column pulse height in conjunction with example voltages at rows 1 and 2.

However, this method of supplying a differential voltage to the electrodes is inefficient because each time a new row is scanned the columns must be discharged and then recharged to the desired voltages by the pulse height modulator. In fact, it is possible to calculate how much energy is required using this method.

For example, the above sequence occurs sixty times a second. So row 302-1 will also turn one and off sixty times in one second. A standard VGA display contains 640 columns by 480 rows. Therefore, the maximum pulse width of each row is 1/60(480)=34.7 microseconds.

Referring again to FIG. 3, a capacitance 306 will be associated with each intersection of a row and column. Therefore, in column 1, the total capacitance is the parallel combination of C1R1+C1R2+C1R3+ . . . +C1R480, where CxRy is the capacitance at column x, row y. This total capacitance can equal as much as 1 nanofarad, possibly more, depending on the area of the display.

The amount of current required to drive each column is represented by the relationship:

$$\Delta V/\Delta T=I/C.$$

Example values for these parameters would be:

$\Delta V$=50 volts, $\Delta T$=5 microseconds, and

C=1 nanofarad.

Therefore, solving the equation for I yields: I=10 milliamps. Accordingly, the power required to drive 1 column is calculated as follows:

$$P=IV\cdot\text{Duty Cycle}=10\text{ milliamps}\cdot 50\text{ volts}\cdot(5/34.7)\text{ microseconds}=71\text{ milliwatts.}$$

Thus, the total power requirement for the FED would be:

$$P_{total}=P\cdot\text{number of columns}=71\text{ milliwatts}\cdot 1920=137\text{ watts.}$$

This type of power requirement represents a heavy drain on the batteries and renders them useless for such an application.

Attempting to overcome the above-mentioned problems by replacing the pulse width modulators with analog amplifier circuits has heretofore been impractical because continuously operating the amplifiers at the required current levels wastes large amounts of current in the devices which comprise the amplifier. Also, power amplifiers are packaged independently, whereas existing display drivers have multiple outputs per chip.

Therefore, it is an object of the present invention to overcome the above shortcomings.

SUMMARY OF THE INVENTION

In order to achieve the above objectives, an apparatus is provided for modulating a conductive element in an FED device from a first level to a second level. In one embodiment, the apparatus comprises a primary modulator having a first input connected to a first signal representative of the second level, an output connected to the conductive element, and a second input connected to a first signal representative of the output; and a connector of a modifying voltage to the output, the connector having a first input connected to a second signal representative of the second level and a second input connected to a second signal responsive to the output.

According to another embodiment of the invention, a field emission display is provided which has a plurality of row address lines which intersect with a plurality of column address lines, the intersections being associated with pixels, a group of emitters associated with the pixels, the emitters being responsive to a voltage difference between the row address lines and the column address lines, and a circuit for controlling the voltage difference. According to one embodiment, the circuit comprises an analog modulating circuit which receives a feedback signal responsive to an actual row-column voltage difference and a target signal responsive to a desired row-column voltage difference, and generates an output signal responsive to the feedback signal and the target signal; a switching circuit which generates a switching signal responsive to the feedback signal, the target signal and a bias signal; and a switch which connects a reference voltage to the output in response to the switching signal; wherein the voltage difference is responsive to the output.

According to still another embodiment, a process is provided for modulating a conductive element in an FED device from a first voltage level to a second voltage level, the conductive element being connected to the output line of a primary modulator, the process comprising the steps of receiving an input signal representative of the second level; connecting a modifying voltage to the output line of the primary modulator if the difference between the input signal and the output signal is different from a first predetermined level.

BRIEF DESCRIPTION OF THE DRAWINGS

For a more complete understanding of the invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 4:
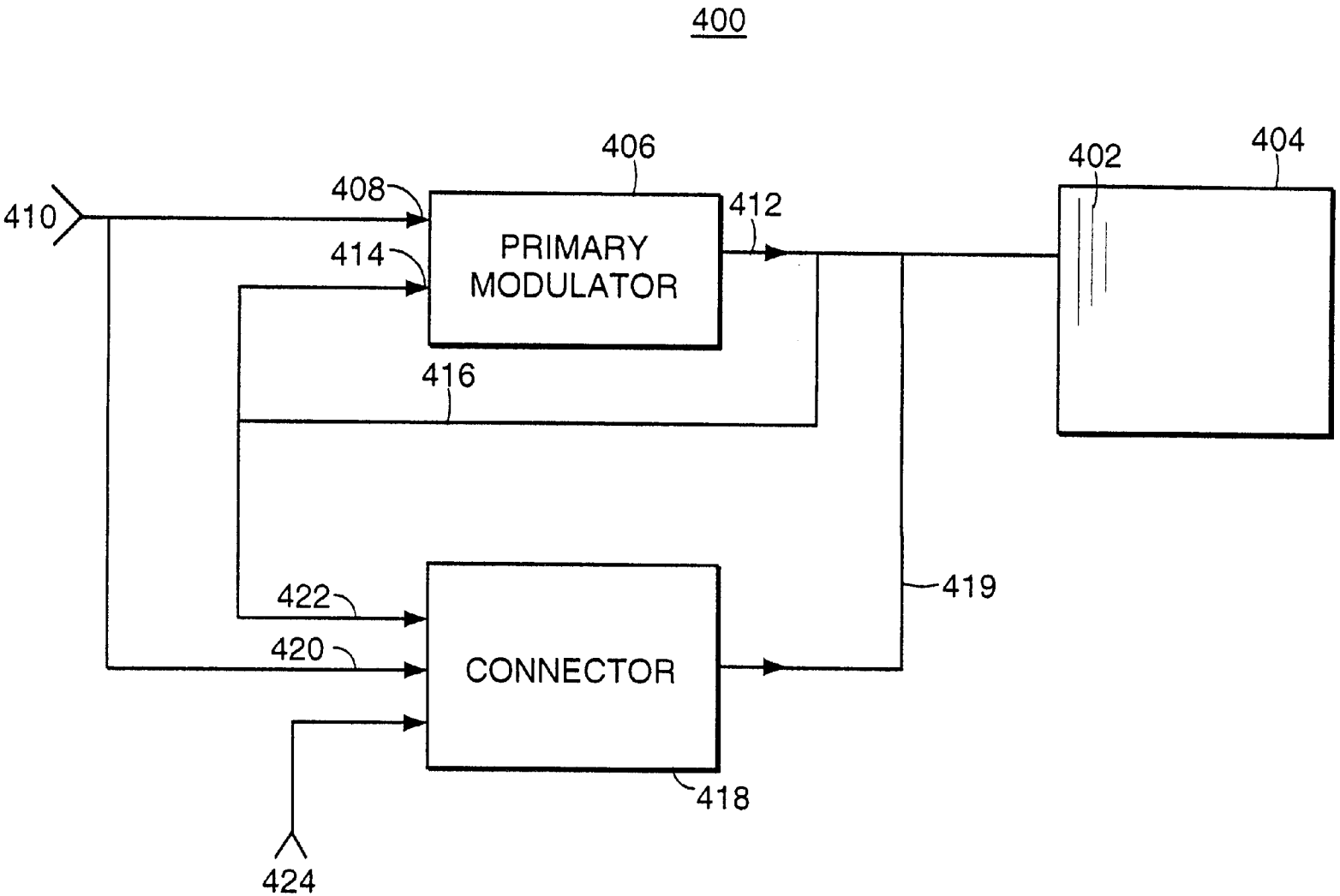
FIG. 4 is a schematic diagram of a circuit according to an embodiment of the invention.

Referring now to FIG. 4, an apparatus 400 is provided for modulating a conductive element 402 in a flat panel device 404 from a first level to a second level, the apparatus comprising: a primary modulator 406 having a first input 408 connected to a first signal representative of the second level 410, an output 412 connected to the conductive element 402, and a second input 414 connected to a first signal representative of the output 416; and a connector 418 of a modifying voltage 424 to the output 412. According to a further embodiment, the connector 418 comprises a first input 420 connected to a second signal representative of the second level 410 and a second input 422 connected to a second signal responsive to the output 412, and an output that is coupled to the output 412 via a line 419.

Figure 1:
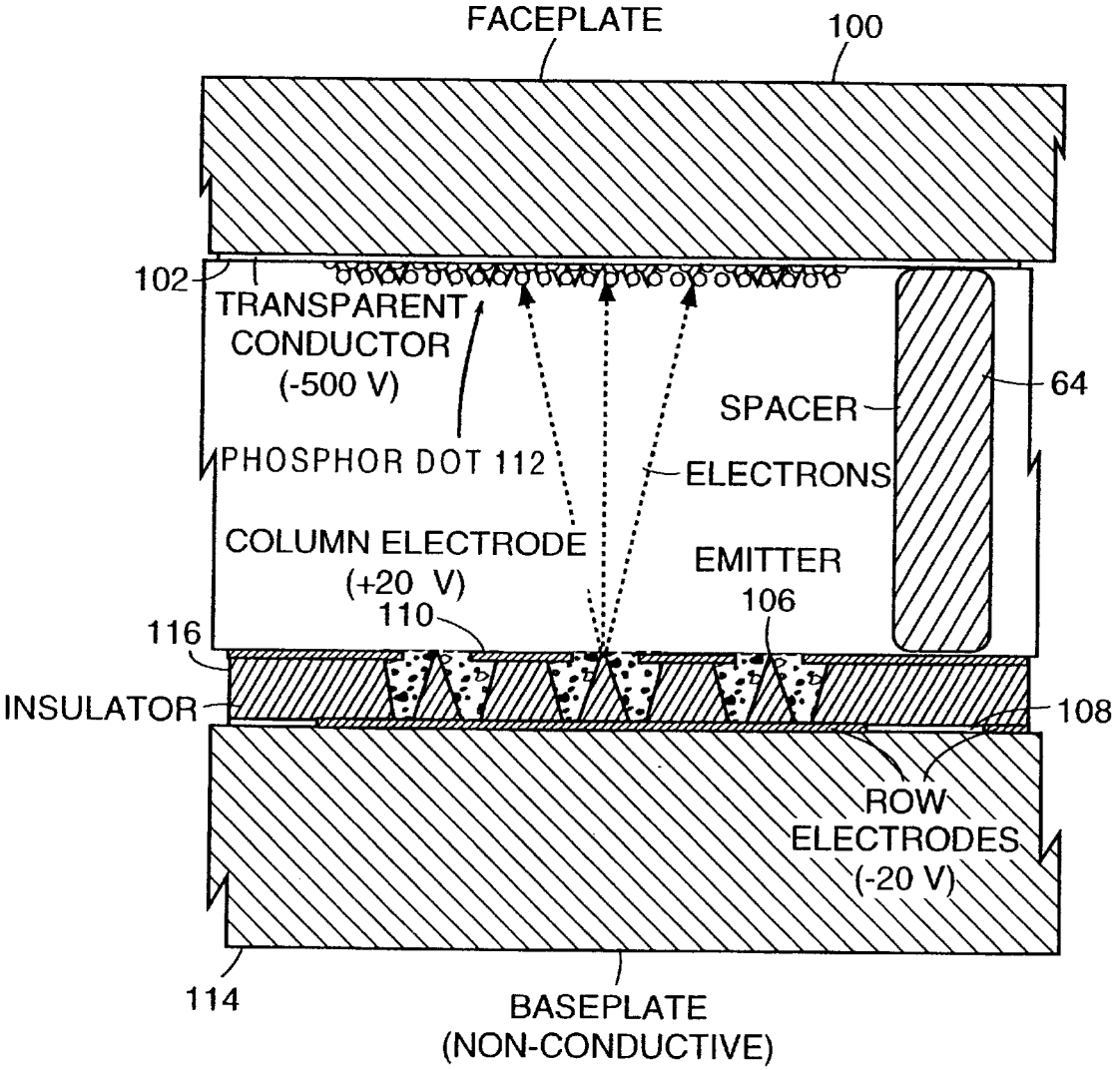
FIG. 1 PRIOR ART
FIG. 1 is a cross-section of an example field emission display.
Figure 2:
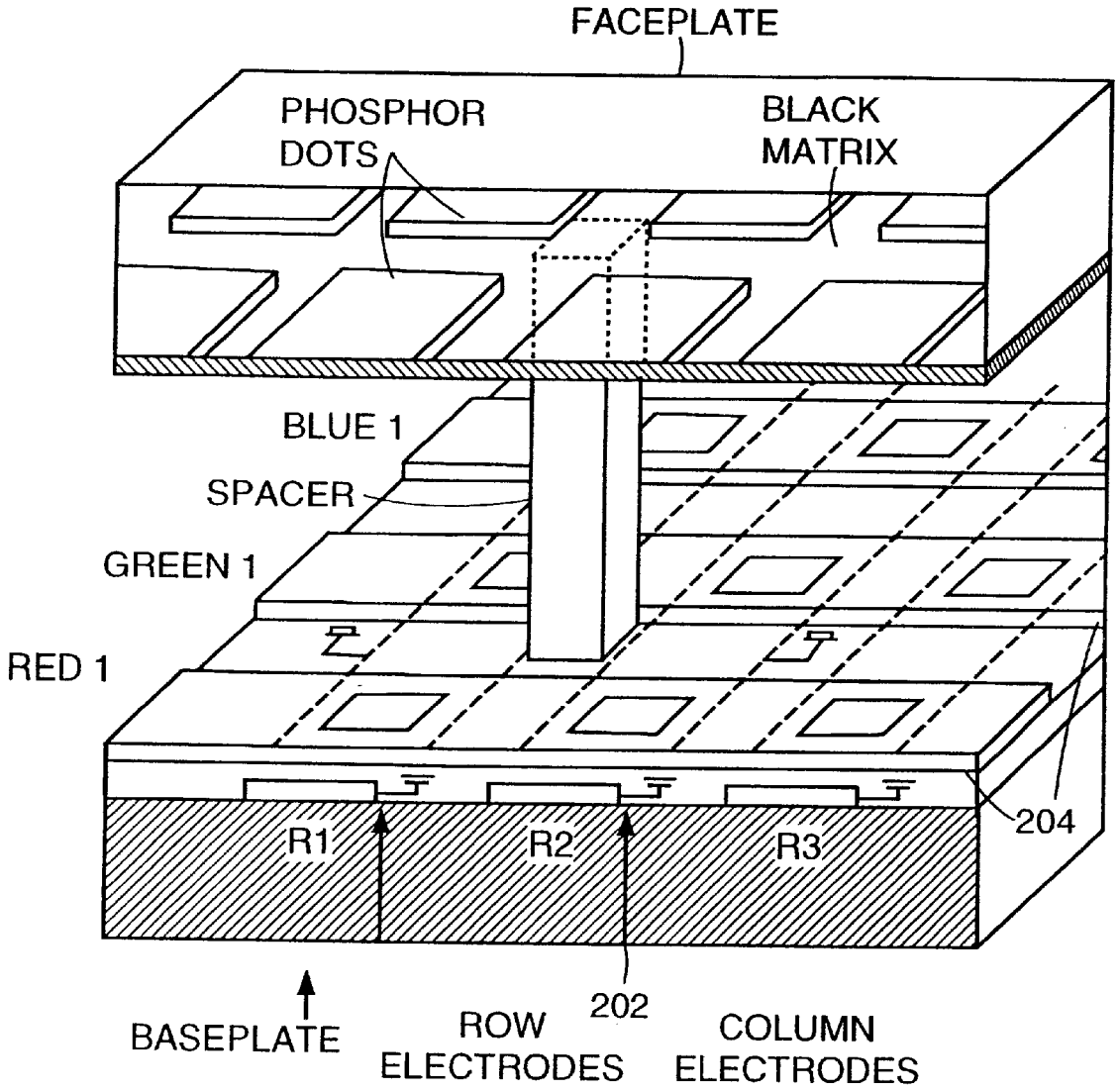
PRIOR ART FIG. 2
FIG. 2 is a three dimensional view of a field emission display.
Figure 3:
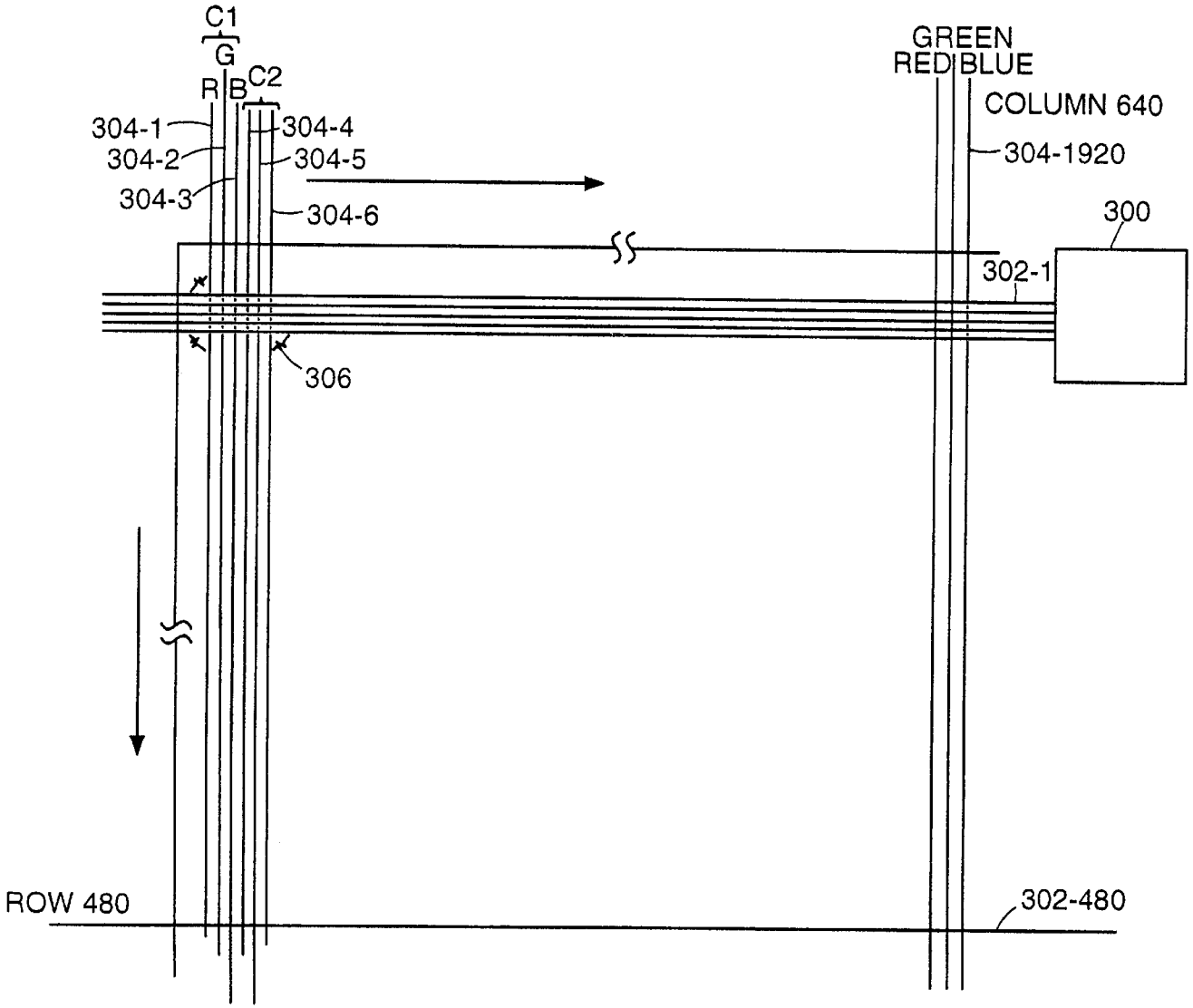
FIG. 3 PRIOR ART
FIG. 3 is a schematic diagram of row and column lines for a field emission display.
Figure 3A:
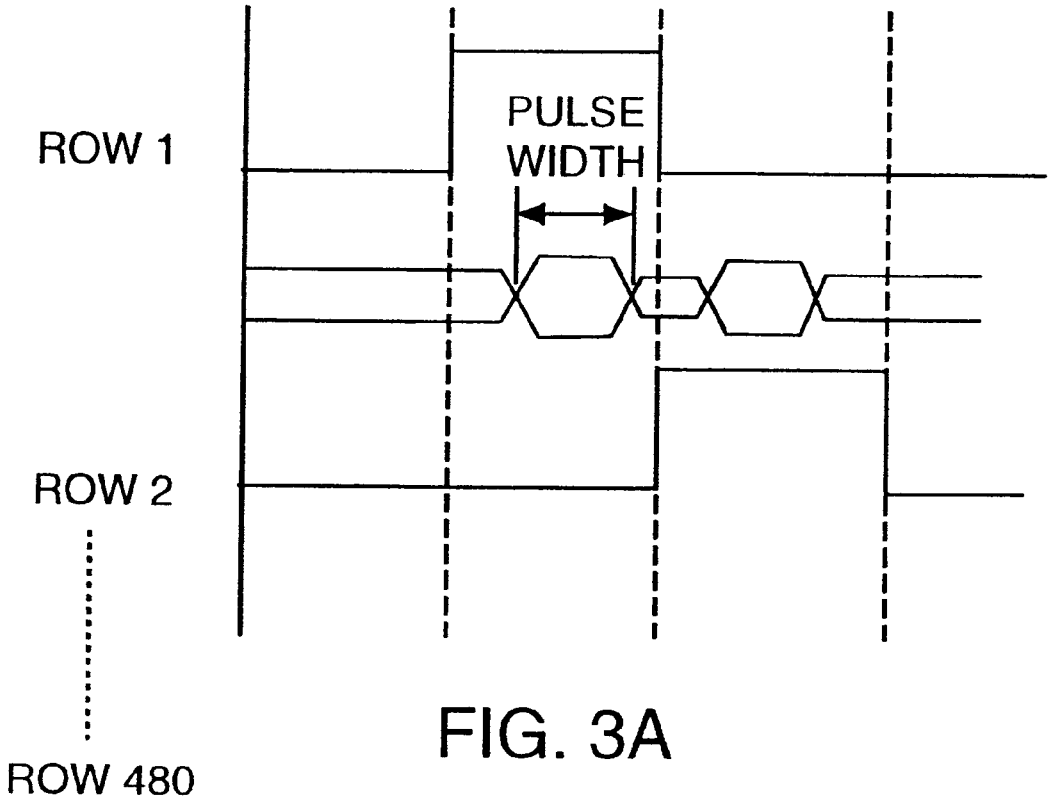
FIG. 3A PRIOR ART
FIG. 3A is a timing diagram of column and row signals.

According to one embodiment, the conductive element 402 is a row or column line such as those shown in FIG. 1. In an alternative embodiment, the output 412 is input to additional circuitry for controlling row or column lines.

An example of an acceptable primary modulator 406 is an operational amplifier, or "op amp," configured as a voltage gain amplifier. A specific op amp known to be useful is a differential to single ended amplifier having two stages of gain. Examples of other acceptable primary modulators are digital to analog convertors, or "DACS," or any voltage (or current) controlled voltage (or current) source.

An example of a modifying voltage 424 is a constant reference voltage. Example voltage levels are between about 0.3 and about 2 volts.

Figure 5:
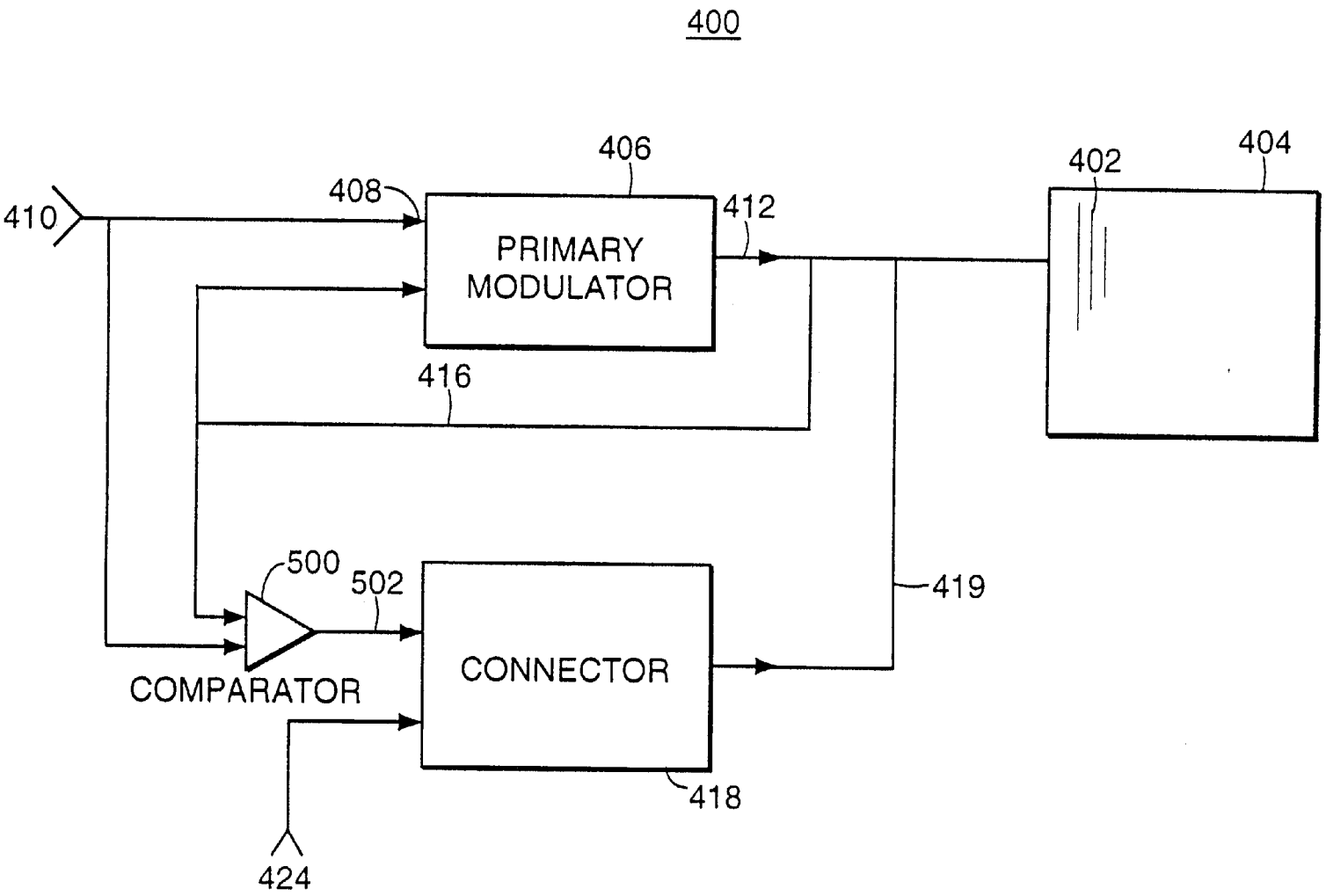
FIG. 5 is a schematic diagram of a circuit according to another embodiment of the invention.

FIG. 5 shows another embodiment of the invention further comprising a comparator 500 of the first signal representative of the second level 410 to the output 412, the comparator 500 having an output representative of the difference, the connector being responsive to the comparator output 502.

Figure 6:
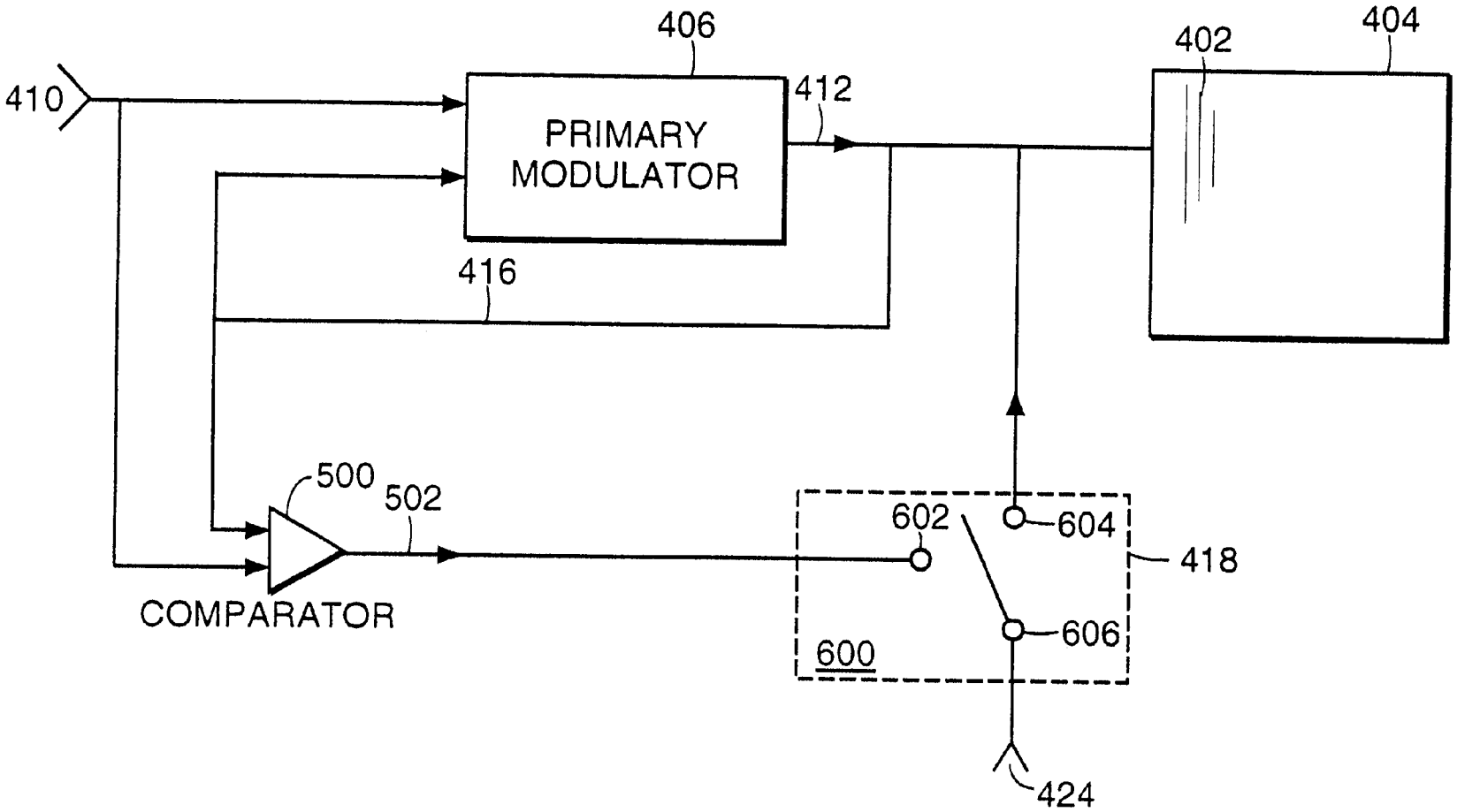
FIG. 6 is a schematic diagram of a circuit according to an embodiment of the invention.

FIG. 6 shows another embodiment of the invention in which the connector 418 comprises a switch 600, the switch 600 having a control terminal 602, a first signal terminal 604 connected to the output, and a second signal terminal 606 connected to the modifying voltage 424. According to another aspect of the invention, the signal terminals (604 and 606) are shorted upon a short signal from the control terminal 602. Several suitable switches are known in the art. For example, according to one embodiment, the switch 600 comprises a transister. Such transistors are often integrated with the circuit. According to a further embodiment, the switch 600 comprises a field effect transistor.

Figure 7:
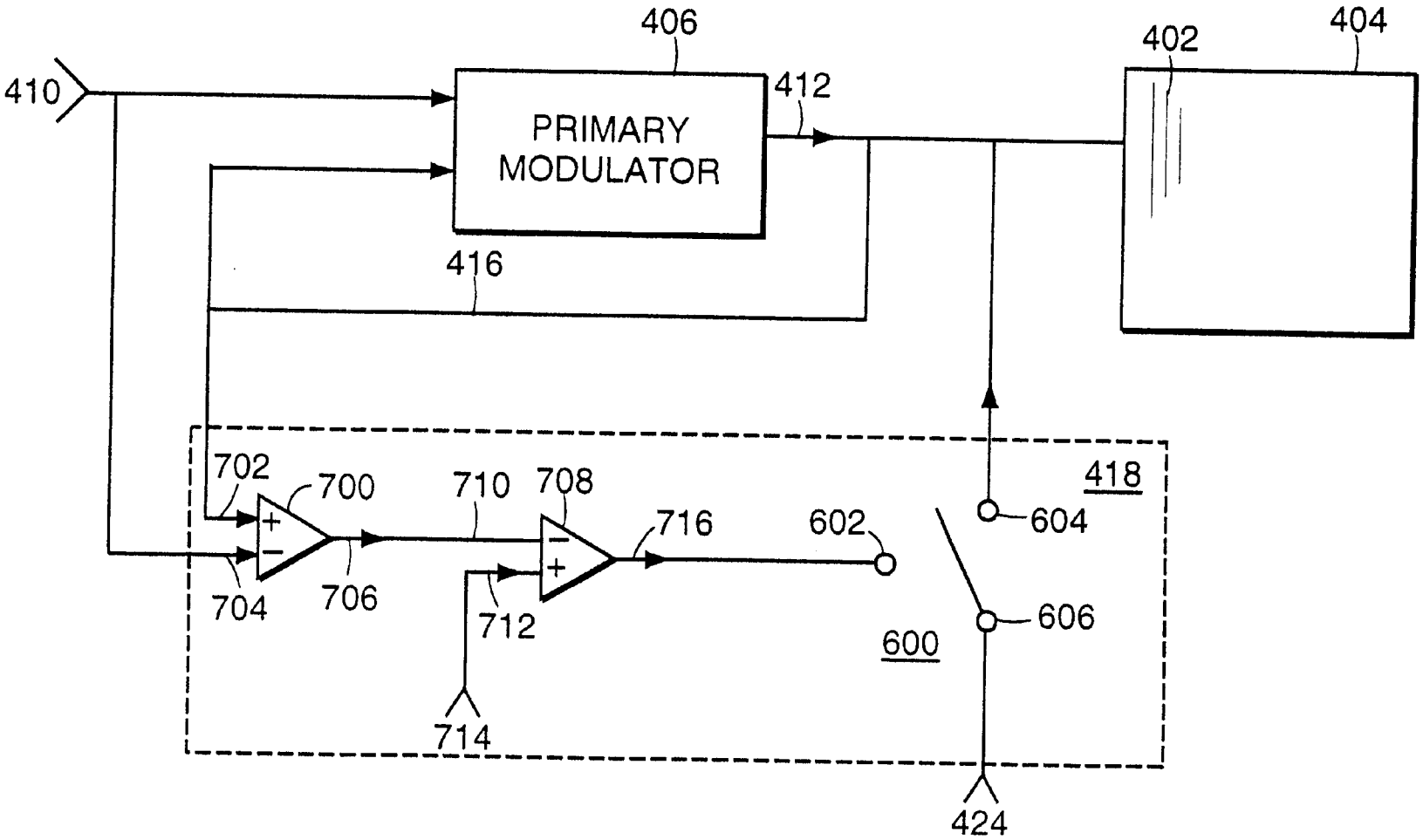
FIG. 7 is a schematic diagram of a circuit according to still another embodiment of the invention.

FIG. 7 shows an embodiment wherein the connector 418 further comprises a first differential amplifier 700 having a first positive input 702 connected to a signal responsive to the output signal 412, a first negative input 704 connected to a signal responsive to a signal responsive to the second level 410, and a first output signal 706 representative of the difference between the signals at the positive input 702 and the negative input 704. According to still a further aspect, the connector comprises a second comparator 708 having a second negative input 710 connected to a signal responsive to the first output signal 706, a second positive input 712 connected to a signal representative of a predetermined value 714, and a second output 716 representative of the difference between the signals at the negative input 710 and the positive input 712, the second output 716 being connected to the control terminal 602 of the switch 600. According to still a further embodiment, the switch 600 further comprises a damper to prevent flicker. An example of a suitable damper is an integrated transistor connected as a capacitor.

Figure 8:
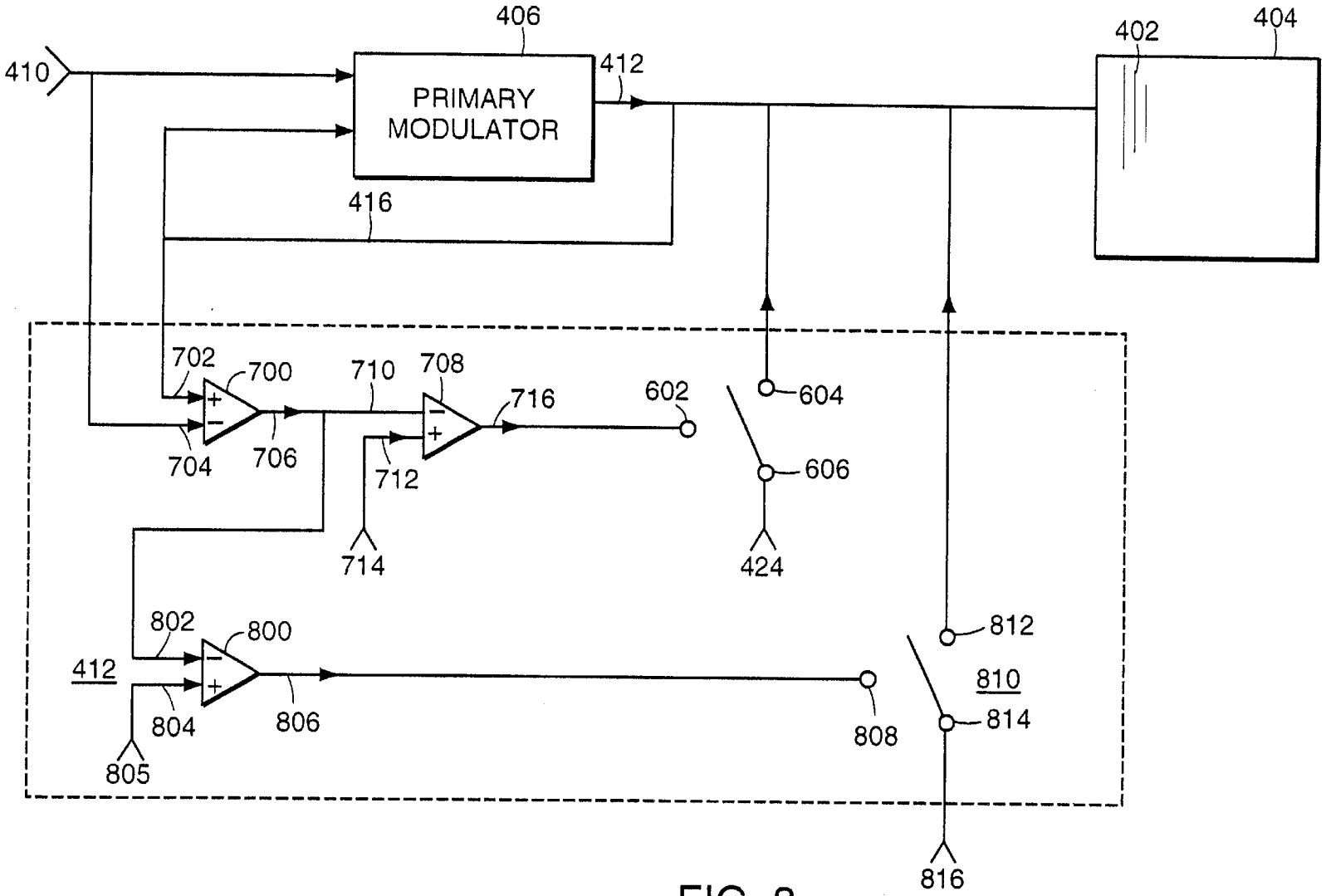
FIG. 8 is a schematic diagram of a circuit according to a further embodiment of the invention.

FIG. 8 shows an embodiment in which the connector 418 further comprises a third comparator 800 having a third negative input 802 connected to a signal responsive to the first output signal 412, a third positive input 804 connected to a signal representative of a predetermined value 805, and a third output 806 representative of the difference between the signals at the negative input 802 and the positive input 804, the third output 806 being connected to the control terminal 808 of a second switch 810 having a control terminal 808 and a pair of signal terminals 812 and 814, one of the pair 812 being connected to the output 412 and the other of the pair 814 being connected to a second modifying voltage 816, wherein the signal terminals 812 and 814 are shorted upon a short signal from the third output 806. In other examples, the second switch further comprises a transistor. Also, the switch further comprises a damper according to other example embodiments.

Referring to FIGS. 1 and 9A–9C, there is provided a schematic diagram of a circuit 900 for use in a field emission display 100 having a plurality of row address lines, or electrodes, 108 which intersect a plurality of column address lines 110, the intersections being associated with pixels, a group of emitters 106 associated with the pixels, the emitters 106 being responsive to a voltage difference between the row address lines 108 and the column address lines. According to this embodiment, the circuit 900 for controlling the voltage difference comprises an analog modulating circuit 936 which receives a feedback signal 940 responsive to an actual row-column voltage difference and a target signal 922 responsive to a desired voltage difference and generates an output signal 938 responsive to the feedback signal 940 and the target signal 922. There is also included a switching circuit, or recovery circuit, 990 which generates a switching signal 960 responsive to the feedback signal 940, the target signal 922 and a bias signal 970; and a switch 954 which connects a reference voltage 956 to the output 938 in response to the switching signal 960. According to this embodiment, the actual row-column voltage difference is responsive to the output 938. A more detailed description of the circuit follows.

Figure 9A:
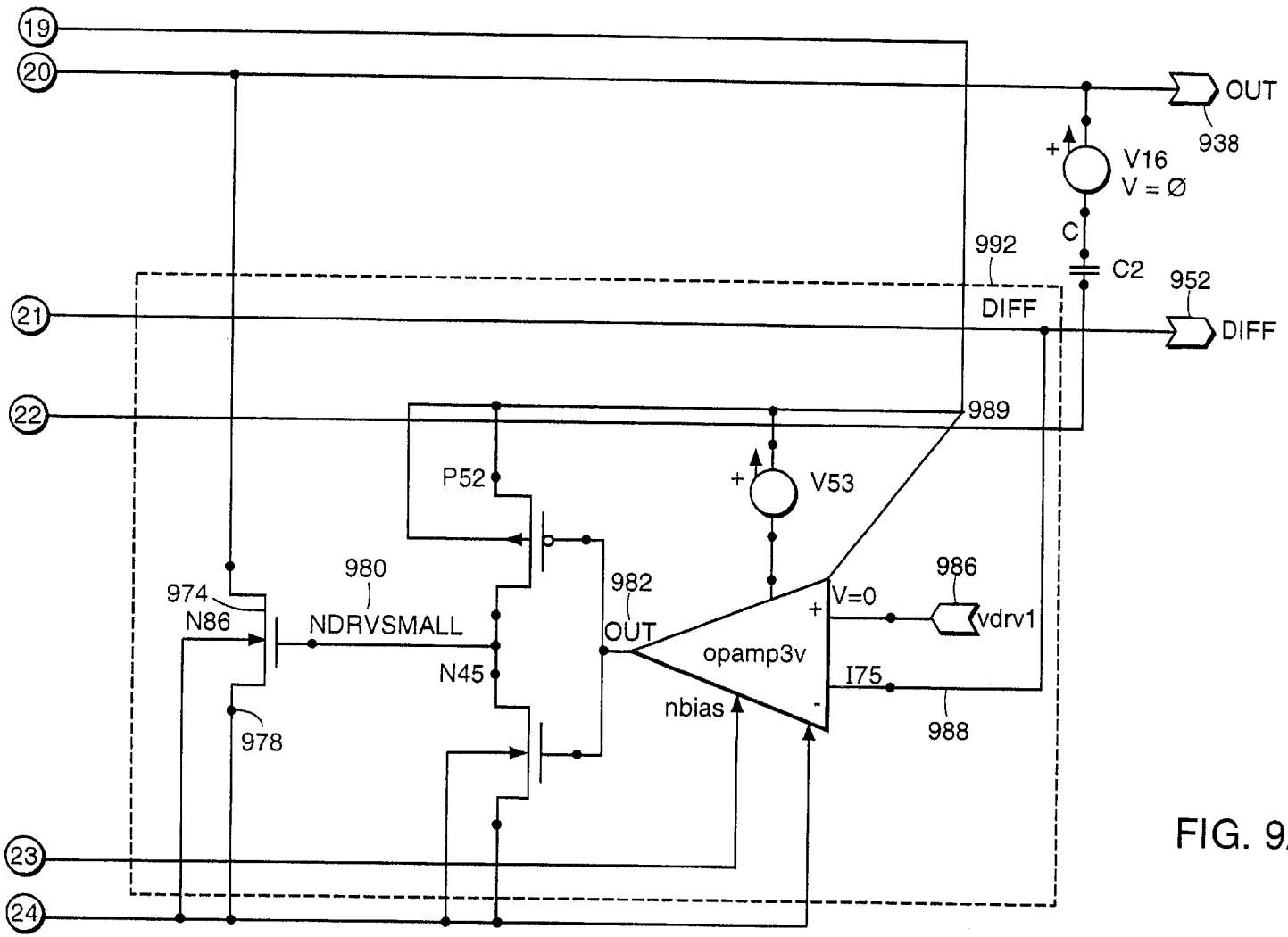
FIGS. 9A–9C are schematic diagrams of circuits according to another embodiment of the invention.
Figure 9B:
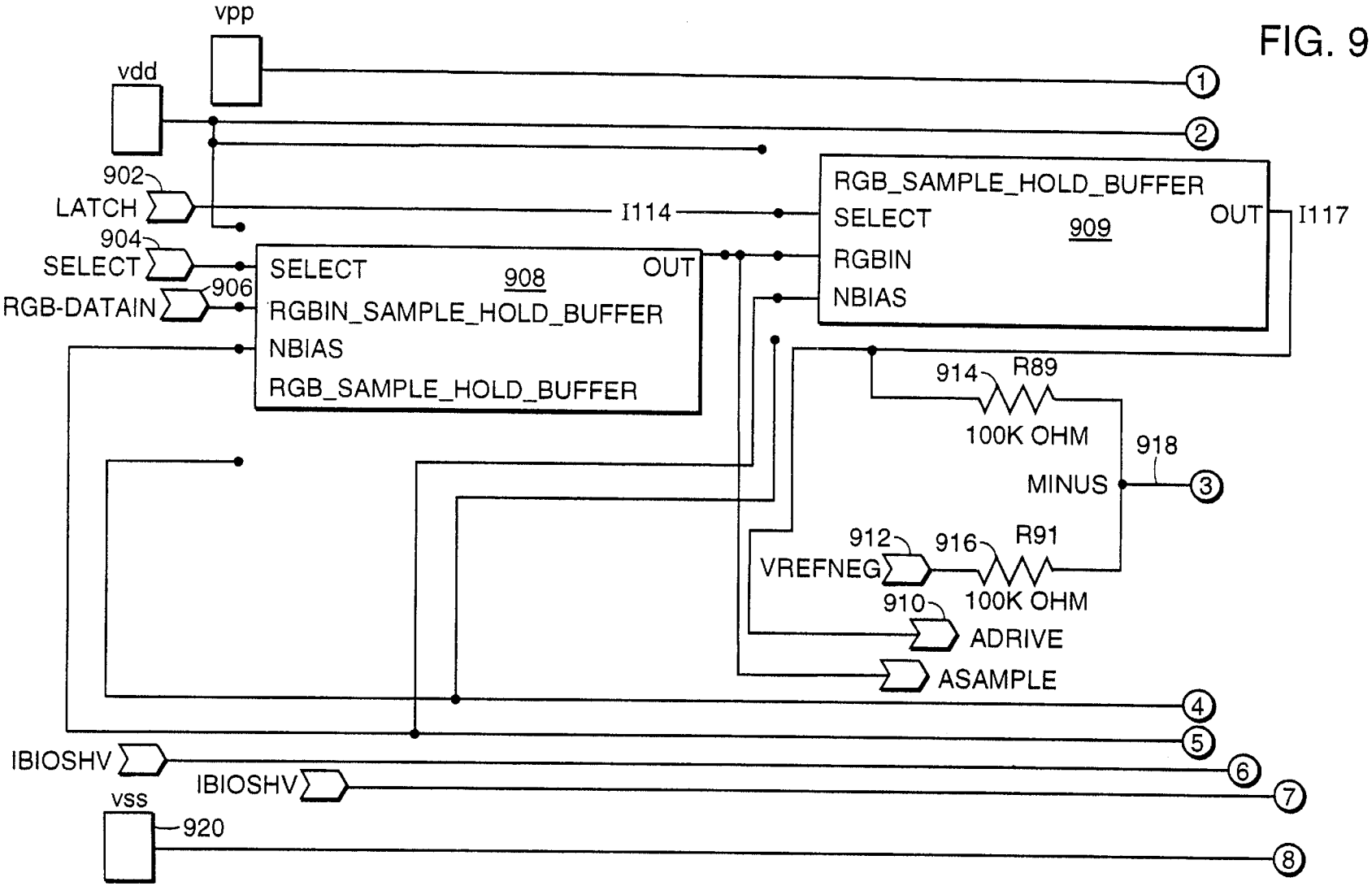
Figures 1, 9C:
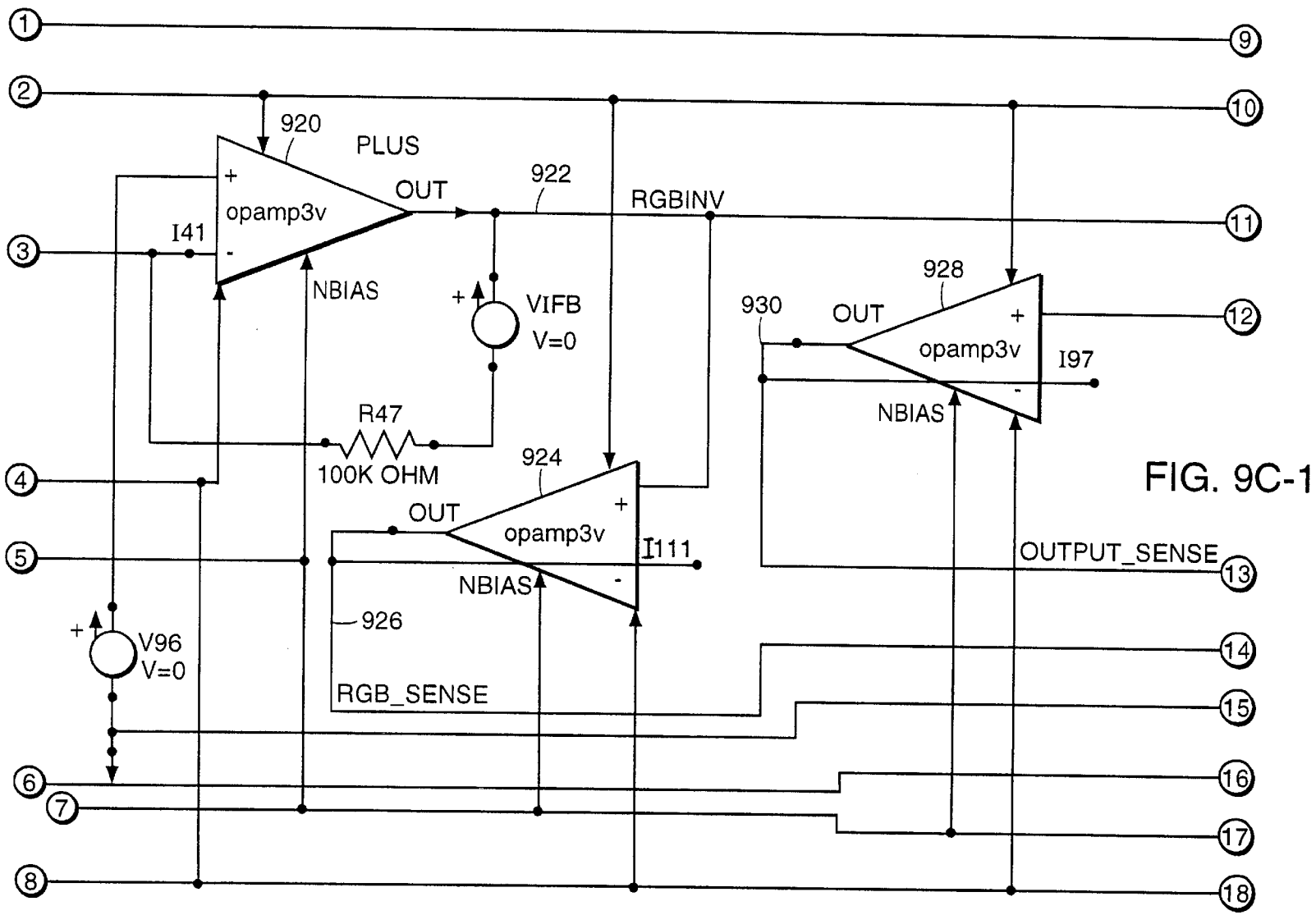
Figures 2, 9C:
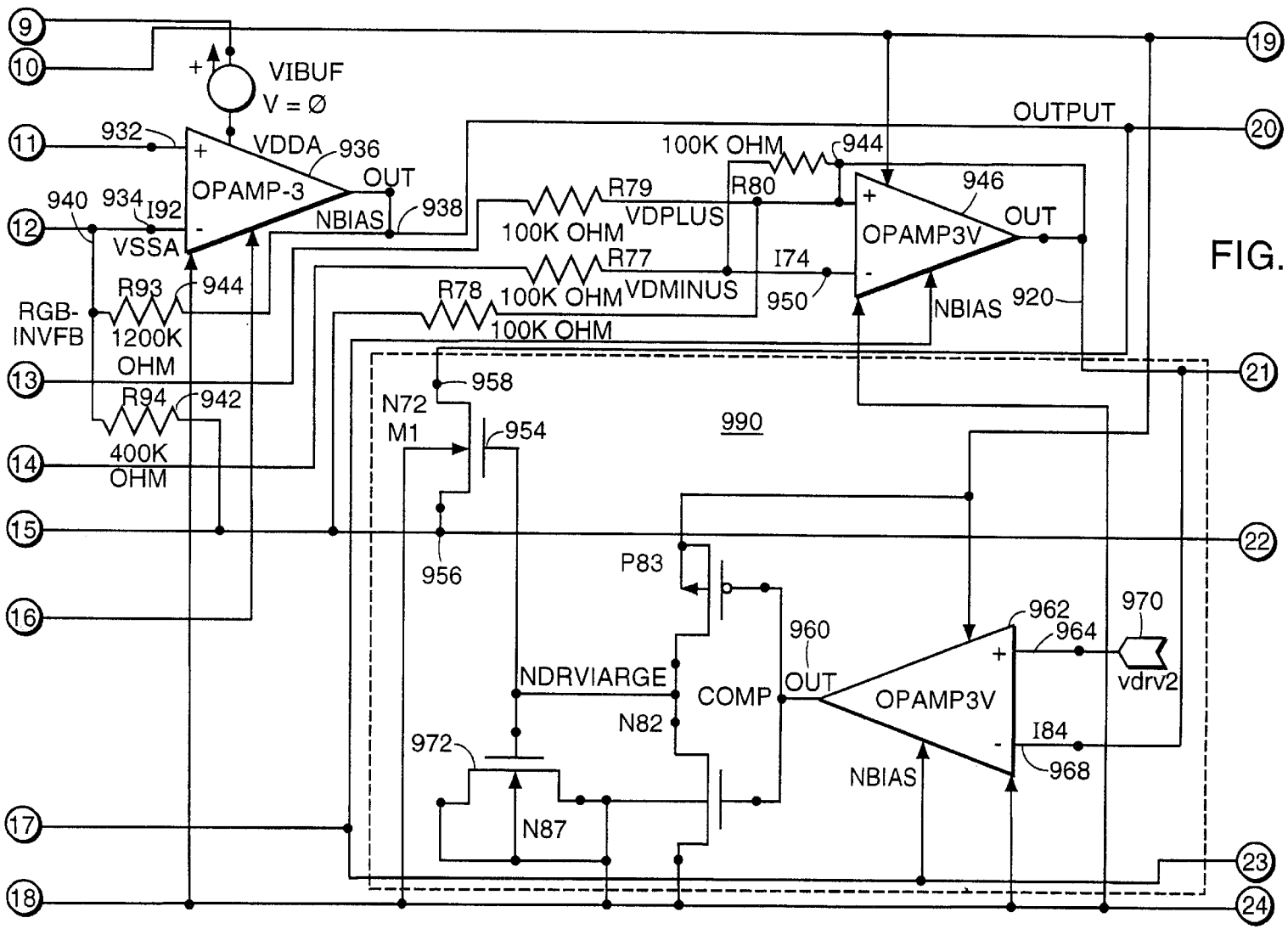

The circuit shown in FIGS. 9A–9C drives one column or row. The information corresponding to the desired brightness for the pixel addressed at the intersection of lines column 1 and row 1 is applied to input line 906. This information is then stored in sample buffer 908. According to one embodiment, buffer 908 comprises a sample and hold circuit. Each column then sequentially acquires the brightness information for the pixel located at its intersection with row 1. The select signal 904 is unique for each row and column, and each column is selected sequentially, for example with a barrel roll register (not shown). The latch 902 is common with all columns and is activated upon completion of sampling of all columns.

Upon latching by a sample buffer 909, a signal 910 is applied as input ADRIVE which, in combination with the signal 912 applied at VREFNEG (for example, 1 volt), to make signal 918 negative, or zero. Resistors 914 and 916, together with VREFNEG and op amp 920 comprise an analog invertor. The high intensity of the display occurs with a negative going signal. However, it is also possible to construct a device according to the invention in which the high intensity occurs with a positive going signal.

The output of op amp 920 comprises a signal 922 which is provided to input 932 of modulator 936. In the embodiment shown in FIGS. 9A–9C, modulator 936 comprises an op amp. Modulator 936 compares signal 922 with the signal 940 which is responsive to output signal 938. Note that resistors 944 and 942 drop the voltage by a ratio responsive to their respective resistances to a logic level useful with later stages where a low voltage level is desired. By this use of low voltage control circuitry, it is possible to use lower power and use less area than would be required if processing were done on a high voltage signal. Note that in this embodiment, controlling high voltages is performed by transistors 954 and 974 as explained more fully below.

Of course, some controlling of high voltages will still be required, for example, when a large differential brightness exists between pixels on the same column at different rows. Requiring modulator 936 to modulate these differences would be a large power drain. This is due, in part, to the fact that large amounts of current are wasted by having pull up and pull down transistors making up modulator 936. This would create large quiescent power dissipation. Therefore, the output of 936 is run at low current, and a low power modulation stage is provided.

Figure 9D:
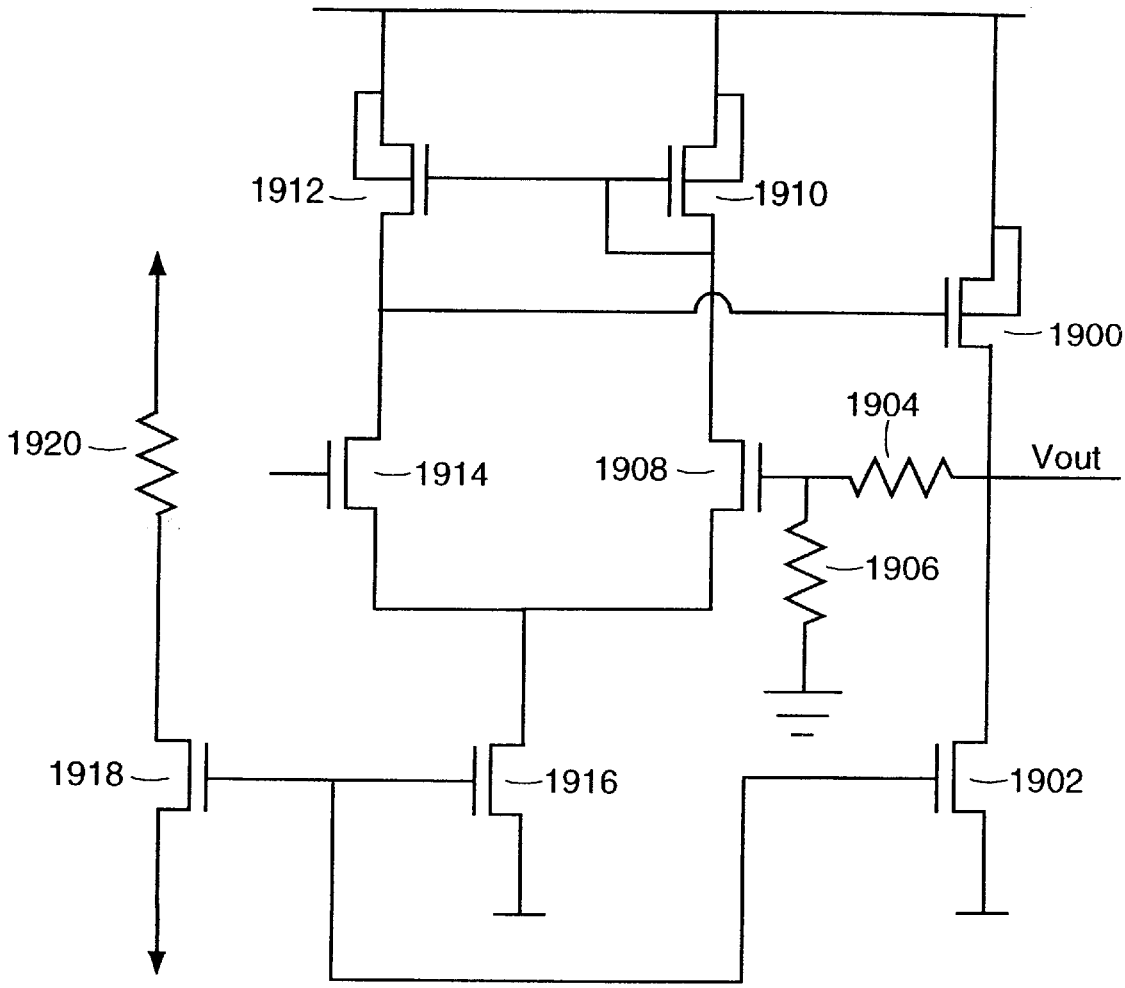
FIG. 9D is a schematic diagram of a circuit according to the present invention.
Figure 9E:
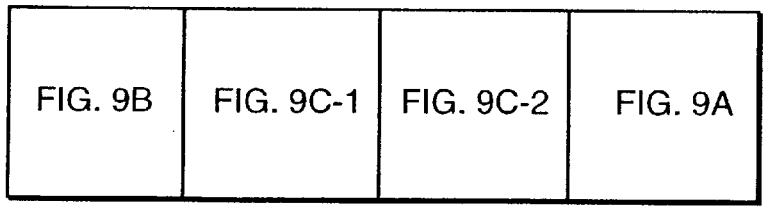
FIG. 9E is a block diagram showing the relationship between FIGS. 9A, 9B, and 9C.

FIG. 9D shows a circuit, according to an embodiment of the invention, which is useful in connection with modulator 936. This circuit is a high voltage/low power op amp. Transistors 1916 and 1902 serve to keep quiescent current low. Specifically, transistor 920, in conjunction with diode connected transistor 1918, form a "current mirror" which is used to control a current through transistor 1902. Transistor 1902 is a weak transistor, which draws, for example, 10 microamps. Transistor 1900 is designed to be a strong transistor which supplies, for example 10 milliamps, or more, while pulling the output higher.

Since it is not desirable to operate modulator 936 at a high current, it is necessary to separately sense and compare a signal responsive to a desired brightness and modify output signal 938 accordingly. This function is performed in the embodiment of FIG. 9 by recovery stages 990 and 992.

As shown in FIGS. 9A–9C, one input to the recovery stages 990 and 992 is generated by op amp 946 as follows.

Buffer 924, senses the signal 922, and buffer 928 senses the output signal 938 after reduction by resistors 940 and 942. The output of buffers 928 and 924 are compared by difference sensor 946 whose output 920 is then applied to recovery stages 990 and 992.

Recovery stage 990 comprises op amp 962 which modulates for high differences. If the difference sensed at the inputs to difference sensor 946 is small, the output 922 of op amp 962 is high, turning off transistor 954. However, if the difference is greater than the voltage level set by signal 970 then transistor 954 turns on. This provides electrical communication between output 938 and signal 956. As the difference at difference sensor 946 goes to zero, signal 952 will cause transistor 954 to turn off. Flicker is prevented by transistor 972, which is connected as a capacitor to serve as a damper. Transistor 972 is, for example, a 100/100 transistor. According to one embodiment, signal 970 is set to about 1.5 volts.

Modulation of small differences is handled, according to one embodiment, by recovery stage 992. Recovery stage 992 comprises op amp 989 and transistor 974. The operation of recovery stage 992 is similar to that of 990 except signal 986 which is set lower than signal 970. When there is a fast approach to the correct level, the transistor 954 of recovery stage 990, which is, for example, a 200/6 N-channel transistor, turns off, and the transistor 974, of recovery stage 992, which is, for example a 20/6 N-channel transistor turns on. Note that as the balanced position between the desired row-column voltage difference and the actual row-column voltage difference is approached, the recovery stages 990 and 992 turn off a bit early, leaving the final modulation to op amp 936, due to its bias current. By slightly undermodulation with the recovery stage, therefore, flicker is also avoided.

Thus, an analog signal is constantly provided to the relevant column line. This saves considerable power in comparison to digital column drivers because the column line is not fully discharged when the display scans from row to row. For example, if the frame 1 the voltage on the pixel is 20 volts and in frame 2 the voltage is required to be 19 volts, the pixel moves only 1 volt, rather than 20 down and 19 up for a swing of 39 volts.

Referring again to FIG. 4, a process for modulating a conductive element 402 in an FED 400 from a first voltage level to a second voltage level, the conductive element 402 being connected to the output line 412 of a primary modulator 406, the process comprising: receiving an input signal 410 representative of the second level; connecting a modifying voltage 424 to the output line 412 of the primary modulator 406 if the difference between the input signal 410 and the output signal 412 is greater than a first predetermined level.

Referring again to FIGS. 5–8, according to another embodiment, a process is provided which further comprises comparing the input signal 410 and the output signal 412, and wherein the connecting comprises shorting the output to a voltage level through a switch 600. In one example, the voltage level comprises a voltage supply for the FED. In another example, the voltage level comprises ground.

In another aspect of the invention, the step of comparing comprises closing the switch 600 if the difference between a signal representative of the input signal 410 and a signal representative of the output signal 412 is more than the first predetermined level. Of course, closing the switch 600 when the difference between the input and the output signals is less than a second predetermined level is also feasible. The first and second predetermined levels are the same in one embodiment, and different in others.

In another embodiment of the invention, in which there is a column electrode charged to establish a first pixel voltage with respect to a first row electrode, a process is provided for establishing a second pixel voltage between the column electrode and a second row electrode. According to an aspect of the invention, the process comprises comparing a first signal representative of an existing column electrode voltage to a second signal representative of a desired second pixel voltage, and adjusting the charge on the column electrode, responsive to the comparison, to establish the second pixel voltage. In this manner, the charge on a column line, or a column electrode, is conserved as subsequent rows are scanned. For example, when a pixel voltage between column electrode 1 and row 1 is generated, it is necessary to charge column electrode 1 to a voltage level sufficient to establish the desired pixel voltage. When it is desired to activate the pixel at column 1, row 2, the charge on column 1 is adjusted until the desired pixel voltage at column 1, row 2 is attained. This prevents the waste of energy in other methods which discharge then recharge the column each time a new row is scanned.

Figure 10A:
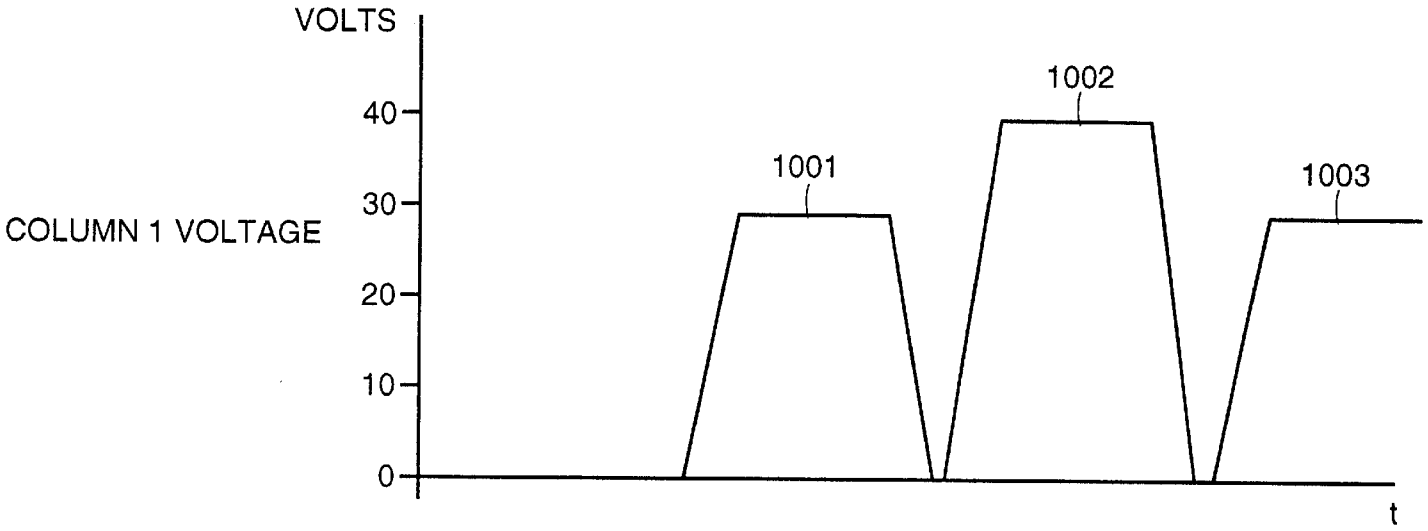
FIGS. 10A–10B are graphs showing a difference between the present invention and other devices.

FIG. 10A shows a graph of a column voltage, for example, column 1, as rows 1, 2 and 3 are scanned. As shown, the desired pixel voltages are 30 volts at row 1, 40 volts at row 2 and 30 volts at row 3. In some displays, when row 1 is scanned, column 1 is charged until it reaches level 1001 of 30 volts. Just before row 2 is scanned, column 1 is drained back to 0 volts. Then, column 1 is recharged to level 1002 of 40 volts. Finally, just before row 3 is scanned, column 1 is discharged back to 0 volts and then recharged to voltage level 1003 of 30 volts.

Figure 10B:
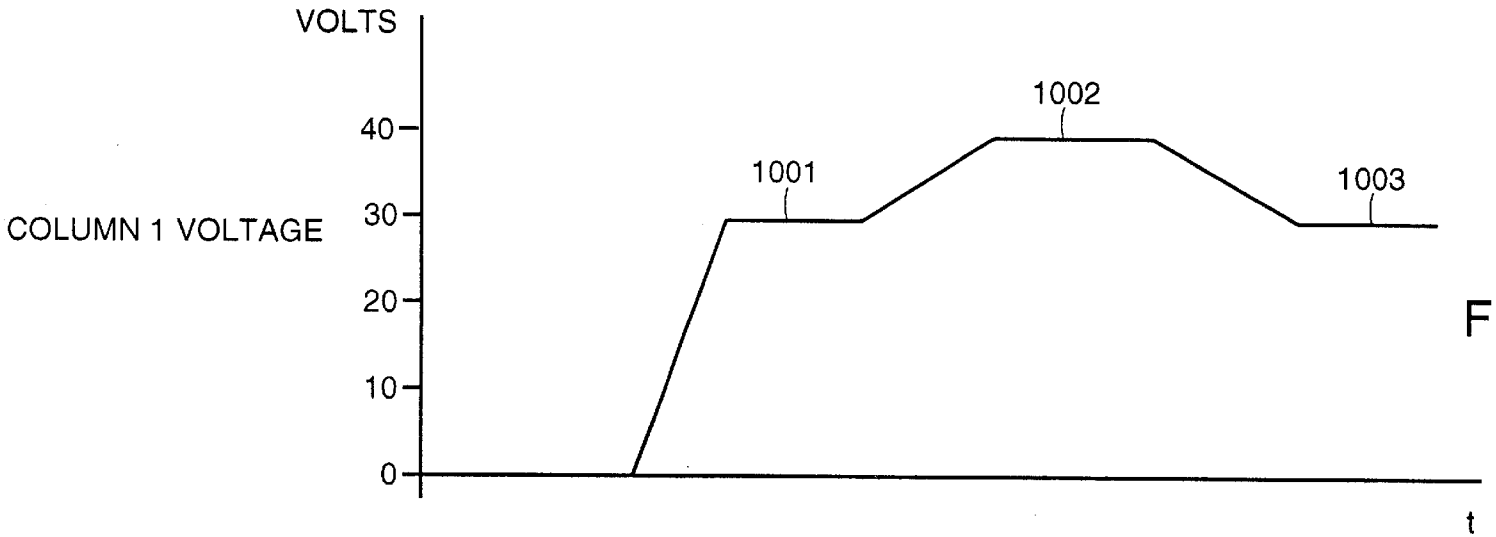

FIG. 10B is a graph, according to an aspect of the invention, in which it is seen that, after column 1 is initially charged to level 1001 of 30 volts, this charge is maintained as subsequent rows are scanned. For example, when row 2 is scanned, column 1 is charged from voltage level 1001 of 30 volts to voltage level 1002 of 40 volts. This represents only an additional charge of 10 volts, rather than a complete discharge of 30 volts followed by a subsequent recharge of 40 volts. Next, when row 3 is scanned, column 1 is discharged from voltage level 1002 of 40 volts to voltage level 1003 of 30 volts. This represents only a discharge of 10 volts with no recharging required. Thus, by conserving charge on column electrodes, as subsequent rows are scanned, it is possible to obtain significant energy savings.

It should be noted, that in the above examples, the column voltage was presumed equal to the desired pixel voltage. However, those who are skilled in the art will recognize that this does not have to be the case, and other embodiments are possible in which the charge on the column electrode is not identical to the desired pixel voltage. However, the aspect of conserving charge on the column as subsequent rows are scanned would still apply.

According to a further embodiment, the step of comparing comprises providing the first and second signals to a circuit which increases the charge on the column electrode if the column electrode voltage is too low to establish the second pixel voltage, and decreases the charge on the column electrode if the column electrode voltage is too high to establish the second pixel voltage.

Figure 11:
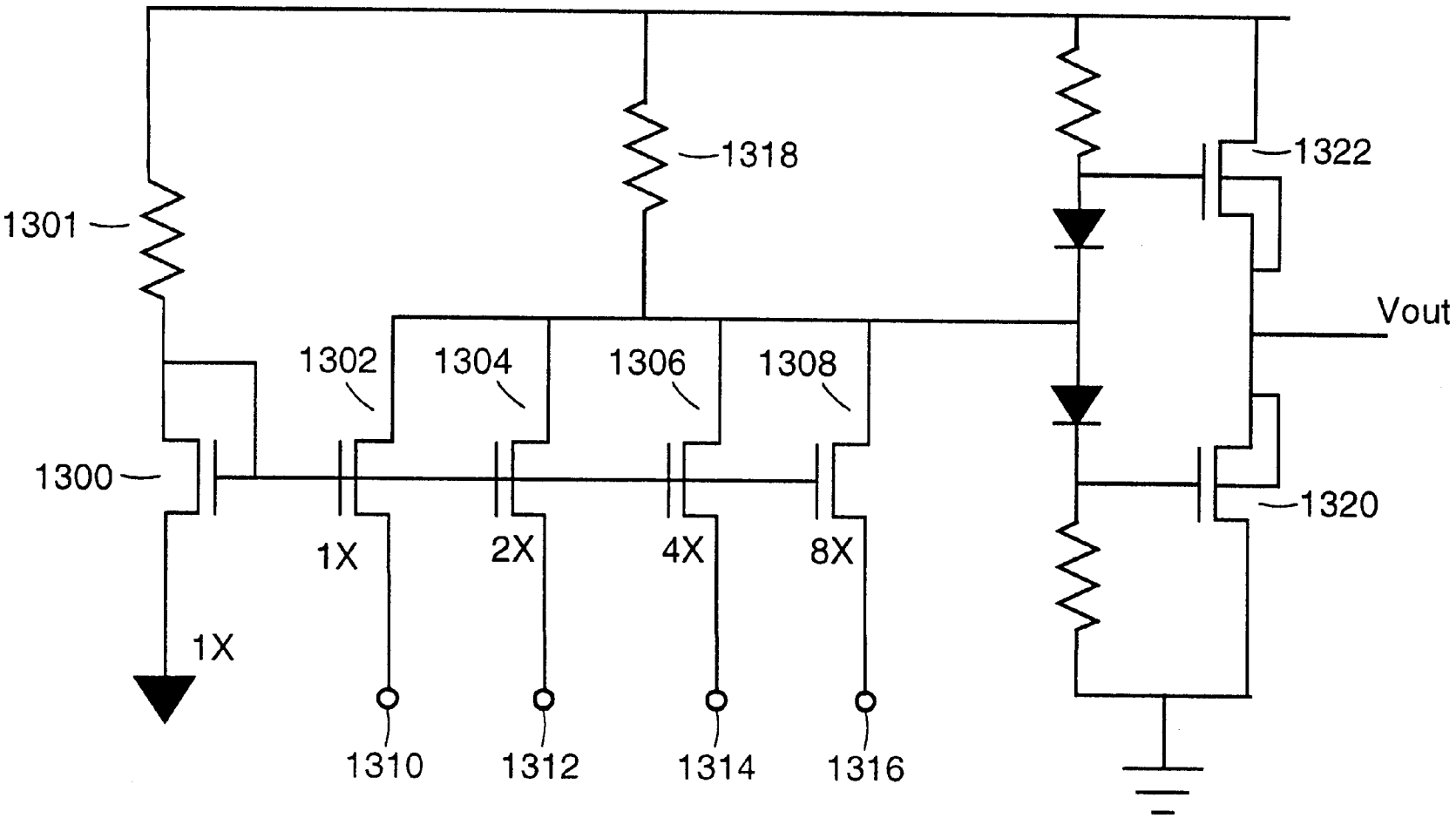
FIG. 11 is a schematic diagram of a circuit according to the present invention.

FIG. 11 is a schematic diagram of a circuit according to still a further embodiment of the invention. In this embodiment, no feedback is required from the output through the electrode in order to adjust the charge.

Specifically, the circuit shown in FIG. 11 is a four-bit digital to analog conversion circuit ("DAC") having a current mirror circuit consisting of transistor 1300 and resistor 1301, in connection with transistors 1302–1308. Transistors 1302–1308 allow for digital inputs 1310–1316, respectively. A first code is provided at inputs 1310–1316 to charge the column line, via $V_{out}$ to a first voltage level. When it is desired to modulate the electrode voltage to a second level, a different code is placed on the inputs. However, it is to be noted that the charge on the column is conserved when the digital code is changed because the output voltage $V_{out}$ is never allowed to go to zero, unless the digital code indicates that zero volts is the desired output voltage. In other words, the column voltage is modulated as shown in FIG. 10B wherein the charge on the column voltage is conserved as it is modulated from one level to the next using this circuit. Those of skill in the art will recognize that the circuit shown in FIG. 11 is simply one embodiment for realizing the subject matter of the invention, and other circuits are possible within the scope of the present invention.

What is claimed is:

1. In a display having a column line, a first row line, a second row line, a first pixel, and a second pixel, said column line being shared by the first and second row lines, a brightness of said first pixel being determined by a voltage difference between said column line and said first row line, a brightness of said second pixel being determined by a voltage difference between said column line and said second row line, said first pixel being dark when a voltage differential between said column line and said first row line equals a reference level, said second pixel being dark when a voltage differential between said column line and said second row line equals said reference level, a process for controlling said first and second pixels, the process comprising:

setting the first pixel to a first desired brightness level comprising the step of setting the voltage of said column line relative to the first row line to a first level;

setting the second pixel to a second desired brightness level comprising the steps of:

comparing a signal representative of said voltage of said column line relative to said first row line to a signal representative of a desired level of said voltage of said column line relative to said second row line to generate a signal representative of the difference between the voltage of said column line relative to said first row line and the desired level of said voltage of said column line relative to said second row line; and in response to said comparison, applying the signal representative of the difference to said column line to set the voltage of said column line relative to said second row line equal to said desired level without setting the voltage of said column line relative to said second row line equal to said reference level.

2. A method according to claim 1, the display including a primary modulator and an output line, the output line being connected to an output of the primary modulator, the voltage on the column line being responsive to a signal on the output line, changing the voltage of the column line comprising:

comparing a signal representative of the second desired level and the signal on the output line; and connecting a first modifying voltage to the output line if the difference between the signal representative of the second desired level and the signal on the output line is greater than a first predetermined level.

3. A method according to claim 2, changing the voltage on the column line further comprising:

connecting a second modifying voltage to the output line if the difference between the signal representative of the second desired level and the signal on the output line is less than a second predetermined level.

4. A method according to claim 3, wherein connecting the second modifying voltage to the output line comprises shorting the output line to a voltage level through a switch.

5. A method according to claim 2, wherein connecting the first modifying voltage to the output line comprises shorting the output line to a voltage level through a switch.

6. A method of constructing a field emission display, comprising:

providing a cathode and an anode, the cathode including a plurality of emitters, the anode defining a screen, the display defining a plurality of pixels, each of the pixels including at least one of the emitters and an associated portion of the screen, electrons emitted by one of said pixel's emitters determining at least in part a brightness of that pixel;

spacing the cathode and the anode apart from one another;

substantially evacuating the space between cathode and the anode to provide a vacuum between the cathode and the anode;

providing a column line, a first row line, and a second row line, said column line being shared by the first and second row lines, an electron emission of an emitter in a first one of the pixels being determined by a voltage between the column line and the first row line, an electron emission of an emitter in a second one of the pixels being determined by a voltage between the column line and the second row line, the first pixel being dark when the voltage differential between the column line and the first row line equals a reference level, the second pixel being dark when the voltage differential between the column line and the second row line equals the reference level;

providing a controller for controlling the brightness of the first and second pixels, the controller comprising:

a comparator for comparing a signal representative of a current value of the voltage of the column line relative to the first row line to a signal representative of a desired level of the voltage of the column line relative to the second row line to generate a signal representative of the difference between the voltage of said column line relative to said first row line and the desired level of said voltage of said column line relative to said second row line; and a circuit for applying the signal representative of the difference to set the voltage of the column line relative to the second row line to the desired level without setting the voltage of the column line relative to the second row line equal to the reference level.

* * * * *